US010639525B2

(12) United States Patent
Ueda et al.

(10) Patent No.: US 10,639,525 B2
(45) Date of Patent: May 5, 2020

(54) GOLF CLUB SET

(71) Applicant: Sumitomo Rubber Industries, Ltd., Hyogo (JP)

(72) Inventors: Naoyoshi Ueda, Kobe (JP); Masahiko Ueda, Kobe (JP); Shimpei Oyama, Kobe (JP); Yuki Nagano, Kobe (JP); Satoru Hanamitsu, Kobe (JP); Tomoya Hirano, Kobe (JP); Kenji Kii, Kobe (JP); Hiroshi Abe, Kobe (JP); Yasushi Sugimoto, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/293,933

(22) Filed: Mar. 6, 2019

(65) Prior Publication Data

US 2019/0282862 A1 Sep. 19, 2019

(30) Foreign Application Priority Data

Mar. 13, 2018 (JP) ..... 2018-045864

(51) Int. Cl.
*A63B 53/00* (2015.01)
*A63B 53/04* (2015.01)

(52) U.S. Cl.
CPC ..... *A63B 53/047* (2013.01); *A63B 2053/005* (2013.01); *A63B 2053/0445* (2013.01); *A63B 2053/0479* (2013.01)

(58) Field of Classification Search
CPC ..... A63B 2053/005; A63B 2053/0483; A63B 2053/0479; A63B 2053/0445; A63B 53/047
See application file for complete search history.

(56) References Cited

U.S. PATENT DOCUMENTS 5,110,131 A * 5/1992 Long ..... A63B 53/00 473/349
5,766,087 A * 6/1998 Kawamatsu ..... A63B 53/04 473/290
9,370,699 B1 * 6/2016 Ines ..... A63B 53/047
2010/0160066 A1 * 6/2010 Jertson ..... A63B 53/047 473/290
2011/0105240 A1 * 5/2011 Abe ..... A63B 53/047 473/291
2012/0157222 A1 * 6/2012 Kii ..... A63B 53/00 473/290

(Continued)

FOREIGN PATENT DOCUMENTS

JP H05-317463 * 12/1993 ..... A63B 2053/0445
JP 2017-158910 A 9/2017

(Continued)

*Primary Examiner* — John E Simms, Jr.

(74) *Attorney, Agent, or Firm* — Studebaker & Brackett PC

(57) ABSTRACT

A golf club set includes a plurality of golf clubs 1 having different loft angles. The golf clubs 1 include at least one 1st golf club 1A having a loft angle of less than 34 degrees, and at least one 2nd golf club 1B having a loft angle of not less than 34 degrees. Each of the at least one 1st golf club 1A and the at least one 2nd golf club 1B comprises a clubface 3 provided with a plurality of face grooves 8 having a depth. The depth of the face grooves 8 of the at least one 2nd golf club 1B is larger than the depth of the face grooves 8 of the at least one 1st golf club 1A.

2 Claims, 8 Drawing Sheets

(56) References Cited

U.S. PATENT DOCUMENTS

| | | | | |
|---|---|---|---|---|
| 2015/0005099 | A1* | 1/2015 | Hettinger | A63B 53/047 473/350 |
| 2016/0059089 | A1* | 3/2016 | Jertson | A63B 53/047 473/290 |
| 2017/0259131 | A1 | 9/2017 | Shimahara | |
| 2017/0259132 | A1 | 9/2017 | Shimahara et al. | |
| 2017/0259133 | A1 | 9/2017 | Shimahara et al. | |

FOREIGN PATENT DOCUMENTS

| | | | |
|---|---|---|---|
| JP | 2017-158920 | A | 9/2017 |
| JP | 2017-158927 | A | 9/2017 |

* cited by examiner

GOLF CLUB SET

TECHNICAL FIELD

The present invention relates to a golf club set including a plurality of golf clubs having different loft angles.

BACKGROUND ART

Various golf club sets including a plurality of golf clubs having different loft angles have been proposed.

In recent years, attempts have been made to optimize various parameters of golf clubs included in a golf club set according to the loft angles of the respective golf club heads. (see, for example, Patent Documents 1 to 3 below)

Patent Document 1: Japanese Patent Application Publication No. 2017-158927

Patent Document 2: Japanese Patent Application Publication No. 2017-158920

Patent Document 3: Japanese Patent Application Publication No. 2017-158910

DISCLOSURE OF THE PRESENT INVENTION

Problems to be Solved by the Invention

In general, a golf club head is provided in its clubface, which is a surface for striking a ball, with a plurality of face grooves extending in the toe-heel direction of the head. Such face grooves increase the frictional force between the clubface and the ball at the time of hitting the ball, and have a function to give an appropriate backspin to the hit ball.

By the way, when playing on a golf course, there are various situations when hitting a ball, for example, from a tee ground, rough, fairway and the like. For example, when hitting a ball from a tee ground, as the ball is teed up, turfgrass is rarely interposed between the clubface and the ball. On the other hand, when hitting from a fairway or rough, since turfgrass is somewhat interposed between the clubface and the ball, such hitting conditions are significantly different from the hitting condition from a tee ground. Further, when playing in rainy weather, moisture is also present between the clubface and the ball, so the hitting condition becomes more complicated.

Heretofore, however, face grooves of golf clubs included in a golf club set have not been designed in consideration of the above described various hitting conditions. For this reason, in the conventional golf club sets, depending on hitting conditions, the amount of backspin of the hit balls is largely changed, and accordingly, it is difficult to properly control the flight distance of the hit ball.

FIG. 8 shows results of measurement of the amount of backspin of a hit ball which measurement was made using three types of golf clubs having different loft angles under various hitting conditions, wherein the vertical axis indicates the amount of backspin (average value of N=8), and the horizontal axis indicates the hitting conditions and the golf club types. The ball hitting position of the clubface and the head speed were the same in all of the golf clubs. The three types of golf clubs were a pitching wedge PW (loft angle 46 degrees), an 8-iron #8 (loft angle 36 degrees) and a 6-iron #6 (loft angle 28 degrees).

In FIG. 8, the meanings of the terms representing hitting conditions are as follows.

"DRY": a dry condition in which no inclusions exist between the clubface and the ball, which corresponds to a hit from a tee ground in fine weather.

"WET": a wet condition in which only moisture is exist between the clubface and the ball, which corresponds to a hit from a tea ground in rainy weather.

"Turfgrass 2" to "Turfgrass 4": dry conditions such that, between the clubface and the ball, 2 to 4 pieces of turfgrass extending vertically along the clubface exist in the toe-heel direction. "Turfgrass 2" corresponds to a hit from a fairway. "Turfgrass 3" corresponds to a hit from a semi-rough. "Turfgrass 4" corresponds to a hit from a rough.

"wet slit paper": this corresponds to a hit from a rough in rainy weather, wherein the ball was hit by a clubface onto which a nonwoven fabric (Du Pont Sontara Maintenance Cloth) of size 56 mm×56 mm was applied, wherein the nonwoven fabric was provided with vertically extending slits at intervals of 5 mm and preliminarily immersed in water.

These hitting conditions had the following relationship as to the friction between the clubface and the ball: DRY>WET>Turfgrass 2>Turfgrass 3>Turfgrass 4>wet slit paper.

As is clear from FIG. 8, it can be seen that, depending on the hitting conditions, the respective golf clubs were greatly changed (fluctuated) in the amount of backspin.

For example, in the case of golf clubs having a relatively large loft angle such as pitching wedge PW and 8-iron #8, there is a tendency that the amount of backspin of the hit ball gradually increases in the order of "DRY", "WET" and "Turfgrass 2". On the other hand, in these golf clubs, the amount of backspin decreases rapidly in the order of "Turfgrass 3", "Turfgrass 4" and "Wet slit paper".

Generally speaking, in these types of golf clubs, when the amount of backspin of the hit ball is decreased, the flight distance becomes longer than expected (so-called "flyer"), and it becomes difficult to stop the ball on the green in the approach shot.

Therefore, with regard to these golf clubs, it is necessary to improve face grooves so that the amount of backspin does not decrease rapidly or remarkably in the hitting conditions "Turfgrass 3", "Turfgrass 4" and "Wet slit paper", namely, generally rough conditions.

On the other hand, in the case of golf clubs having a relatively small loft angle such as 6-iron #6, there is a tendency that the amount of backspin of the hit ball gradually increases in the order of "DRY", "WET", "Turfgrass 2" and "Turfgrass 3". Under the hitting conditions "Turfgrass 4" and "wet slit paper", however, the amount of backspin is almost not changed from that in "Turfgrass 3".

In general, in this type of golf clubs, when the amount of backspin is increased, the hit ball will rise high, and there is a tendency that the originally intended flight distance can not be obtained.

Therefore, in this type of golf clubs, it is necessary to improve the face grooves so that the increase rate of the amount of backspin under a low-frictional hitting condition is suppressed in contrast to the golf clubs having a large loft angle.

OBJECT OF THE INVENTION

Based on the above findings, the present inventions have been devised, and a primarily objective thereof is to provide a golf club set with which, under various hitting conditions possible in a golf course, the amount of backspin of the hit ball is optimized, and the flight distances of the hit balls can be stabilized.

Means for Solving the Problems

Findings Underlying the Present Inventions

For each of the golf clubs having the different loft angles as shown in FIG. 8, the present inventors further investigated the amount of backspin of the hit balls under the various hitting conditions "DRY"–"Wet slit paper".

As a result, it was found that the changing trend of the amount of backspin can be generally distinguished into two trends at a certain loft angle as their boundary.

More specifically, in a 1st golf club having a loft angle of less than 34 degrees, as the friction at the time of hitting a ball is reduced, the amount of backspin of the hit ball is increased, and then the increased amount of backspin is maintained.

On the other hand, in a 2nd golf club having a loft angle of not less than 34 degrees, there is a tendency such that, as the friction at the time of hitting a ball is reduced, the amount of backspin of the hit ball is once increased, and then rapidly decreased.

<First Invention>

According to a first invention, a golf club set include a plurality of golf clubs having different loft angles, wherein the golf clubs include at least one 1st golf club having a loft angle of less than 34 degrees, and at least one 2nd golf club having a loft angle of not less than 34 degrees, wherein each of the above-said at least one 1st golf club and the above-said at least one 2nd golf club comprises a clubface provided with a plurality of face grooves having a depth, and the depth of the face grooves of the above-said at least one 2nd golf club is greater than the depth of the face grooves of the above-said at least one 1st golf club.

In the first invention, based on the above findings, the depth of the face grooves of the 2nd golf club is set to be larger than the depth of the face grooves of the 1st golf club. As a result, under the low-frictional hitting condition of the 2nd golf club, the hit ball deeply engages with the face grooves, and the remarkable decrease in the amount of backspin can be suppressed.

On the other hand, under the low-frictional hitting condition of the 1st golf club, the hit ball engages shallowly with the face grooves, and the increase in the amount of backspin can be suppressed.

Therefore, in the golf club set of the first invention, under the various hitting conditions possible in a golf course, the variation in the amount of backspin of the hit balls can be suppressed, and the flight distances of the hit balls can be stabilized.

In the first invention, the depth of the face grooves of the above-said at least one 1st golf club may be less than 0.38 mm, and the depth of the face grooves of the above-said at least one 2nd golf club may be not less than 0.38 mm.

<Second Invention>

According to a second invention, a golf club set include a plurality of golf clubs having different loft angles, wherein the golf clubs include at least one 1st golf club having a loft angle of less than 34 degrees, and at least one 2nd golf club having a loft angle of not less than 34 degrees, wherein each of the above-said at least one 1st golf club and the above-said at least one 2nd golf club comprises a clubface provided with a plurality of face grooves at a pitch, and the pitch of the face grooves of the above-said at least one 2nd golf club is smaller than the pitch of the face grooves of the above-said at least one 1st golf club.

In the second invention, based on the above findings, the face groove pitch of the 2nd golf club is set to be smaller than the face groove pitch of the 1st golf club.

As a result, in the low-frictional hitting condition of the 2nd golf club, the hit ball comes into contact with more of the face grooves, and the remarkable decrease in the amount of backspin can be suppressed.

On the other hand, in the low-frictional hitting condition of the 1st golf club, the hit ball comes into contact with lesser face grooves, and the increase in the amount of backspin can be suppressed.

Therefore, in the golf club set of the second invention, under the various hitting conditions possible in a golf course, the variation in the amount of backspin of the hit balls can be suppressed, and the flight distances of the hit balls can be stabilized.

In the second invention, the pitch of the face grooves of the above-said at least one 1st golf club may be not less than 3.35 mm, and the pitch of the face grooves of the above-said at least one 2nd golf club may be less than 3.35 mm.

<Third Invention>

According to a third invention, a golf club set includes a plurality of golf clubs having different loft angles, wherein the golf clubs include at least one low-number golf club having a loft angle of less than 26 degrees, at least one middle-number golf club having a loft angle of not less than 26 degrees and less than 39 degrees, and at least one high-number golf club having a loft angle of not less than 39 degrees, wherein each of the above-said at least one low number-golf club, the above-said at least one middle-number golf club and the above-said at least one high-number golf club comprises a clubface provided with a plurality of face grooves having a depth, the depth of the face grooves of the above-said at least one high-number golf club is greater than the depth of the face grooves of the above-said at least one middle-number golf club, and the depth of the face grooves of the above-said at least one middle-number golf club is greater than the depth of the face grooves of the above-said at least one low-number golf club.

The present inventors made a further detailed analysis of the amount of backspin of the balls hit by the golf clubs included in the golf club set under the various conditions "DRY"-"Wet slit paper" as shown in FIG. 8. As a result, it was found that the changing trend of the amount of backspin can be distinguished into the following three trends in more detail:

(1) in the low-number golf club, when the reducing of the friction at the time of hitting a ball is progressed, even after the amount of backspin of the hit ball is increased, the increased amount of backspin is maintained;

(2) in the high-number golf club, when the reducing of the friction at the time of hitting a ball is progressed, the amount of backspin of the hit ball once increases, and then decreases remarkably; and (3) in the middle number golf clubs whose loft angle is not less than 26 degrees and less than 39 degrees, their trends gradually changes from the above trend of the low-number golf club to the above trend of the high-number golf club as the loft angle increases.

Therefore, in the third invention, based on the above findings, the depth of the face grooves of the high-number golf club is set to be larger than the depth of the face grooves of the middle-number golf club, and the depth of the face grooves of the middle-number golf club is set to be larger than the depth of the face grooves of the low-number golf club.

As a result, in the low-frictional hitting condition of the high-number golf club, the hit ball deeply engages with the face grooves, and the remarkable decrease in the amount of backspin is suppressed.

In the low-frictional hitting condition of the low-number golf club, the hit ball engages shallowly with the face grooves, and the increase in the amount of backspin can be suppressed. Further, the face grooves of the middle-number golf club are provided with intermediate characteristics of face grooves between the low-number golf club and the high-number golf club, so the amount of backspin is stabilized.

Therefore, in the golf club set of the third invention, under the various hitting conditions possible in a golf course, it is possible to suppress the variation in the amount of backspin of the hit balls, and also to stabilize the flight distances of the hit balls.

In the third invention, the depth of the face grooves of the above-said at least one low-number golf club may be not more than 0.30 mm, and the depth of the face grooves of the above-said at least one high-number golf club may be not less than 0.40 mm.

<Fourth Invention>

According to a fourth invention, a golf club set includes a plurality of golf clubs having different loft angles, wherein the golf clubs include at least one low-number golf club having a loft angle of less than 26 degrees, at least one middle-number golf club having a loft angle of not less than 26 degrees and less than 39 degrees, and at least one high-number golf club having a loft angle of not less than 39 degrees, wherein each of the above-said at least one low-number golf club, the above-said at least one middle-the number golf club and the above-said at least one high-number golf comprises a clubface provided with a plurality of face grooves at a pitch, the pitch of the face grooves of the above-said at least one high-number golf club is smaller than the pitch of the face grooves of the above-said at least one middle-number golf club, and the pitch of the face grooves of the above-said at least one middle-number golf club is smaller than the pitch of the face grooves of the above-said at least one low-number golf club.

In the fourth invention, based on the above findings (1), (2) and (3), the pitch of the face grooves of the high-number golf club is made smaller than the pitch of the face grooves of the middle-number golf club, and the pitch of the face grooves of the middle-number golf club is made smaller than the pitch of the face grooves of the low-number golf club.

As a result, in the low-frictional hitting condition of the high-number golf club, the hit ball comes into contact with more of the face grooves, and the remarkable decrease in the amount of backspin can be suppressed.

In the low-frictional hitting condition of the low-number golf club, the hit ball contacts lesser face grooves, and the increase in the amount of backspin can be suppressed.

Further, the face grooves of the middle-number golf club are provided with intermediate characteristics of face grooves between the low-number golf club and the high-number golf club, so the amount of backspin is stabilized.

Therefore, in the golf club set of the fourth invention, under the various hitting conditions possible in a golf course, it is possible to suppress the variation in the amount of backspin of the hit balls, and to stabilize the flight distances of the hit balls.

In the fourth invention, the pitch of the face grooves of the above-said at least one low-number golf club may be not less than 3.40 mm, and the pitch of the face grooves of the above-said at least one high-number golf club may be not more than 3.30 mm.

Advantageous Effects of the Inventions

According to the present inventions it is possible to provide golf club sets with which, under various hitting conditions possible in a golf course, the amount of backspin of the balls hit by the golf clubs having different loft angles can be optimized, and the flight distances of the hit balls can be stabilized.

DETAILED DESCRIPTION OF THE INVENTION

Embodiments of the present inventions will now be described in detail in conjunction with accompanying drawings. However, the following embodiments and their specific configurations described below are only for understanding the concepts of the present inventions, and the present inventions are not limited thereto.

The golf club set of each embodiment includes a plurality of golf clubs having different loft angles.

Figure 1:
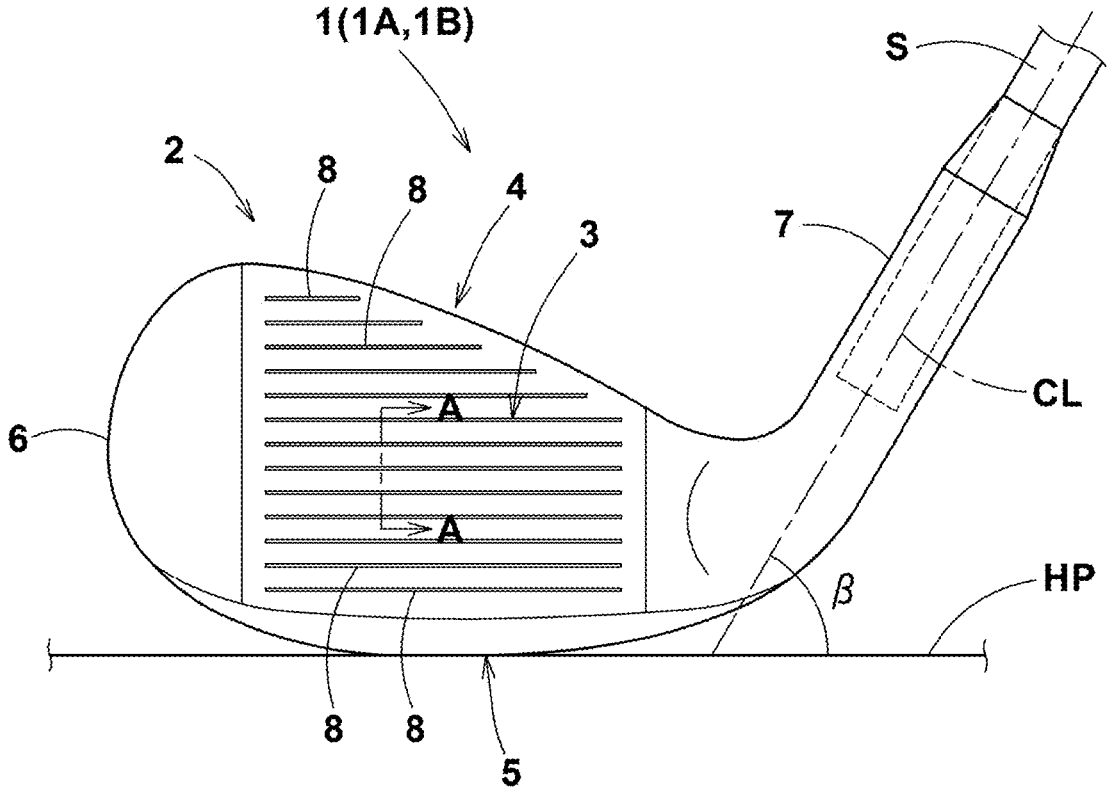
FIG. 1 shows a partial front view of an iron golf club exemplifying two golf clubs included in golf club sets as first, second and third embodiments of the first, second and third inventions, respectively.
Figure 2:
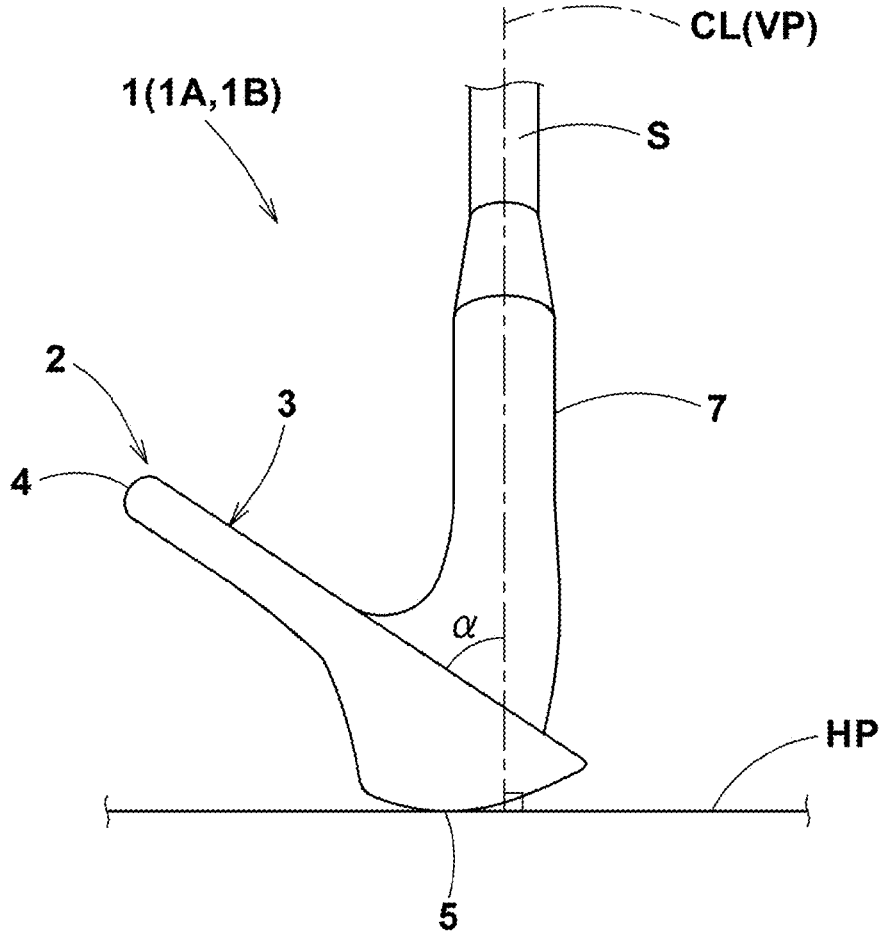
FIG. 2 is a partial side view of the golf club shown in FIG. 1.

FIG. 1 and FIG. 2 are a front view and a side view from the toe side, respectively, of a part (golf club head 2) of an exemplary golf club 1 included in the golf club set.

As shown in FIG. 1 and FIG. 2, the golf club 1 comprises a golf club head 2 for striking a ball (hereinafter, may be simply referred to as the head), and a clubshaft S whose tip end is fixed to the head 2. The golf club 1 in this example is configured as a typical iron club.

Based on a golf club set of iron-type golf clubs, the present embodiments are described hereinafter.

Such iron-type golf club set includes a plurality of golf clubs which may be selected from 3 to 9-irons, pitching wedges, approach wedges and sand wedges.

<Definition of Reference State>

FIG. 1 and FIG. 2 show the golf club 1 in its reference state.

In this specification, the reference state of a golf club means a state in which a club head 2 of the golf club is set on a horizontal plane HP so that the center line CL of a clubshaft S of the golf club lies in a reference vertical plane VP perpendicular to the horizontal plane HP, and face grooves 8 formed in a clubface 3 of the club head 2 become parallel with the horizontal plane HP and reference vertical plane VP.

The "loft angle" is an angle α (shown in FIG. 2) between the reference vertical plane VP and the clubface 3 under the reference state.

The "lie angle" is an angle β (shown in FIG. 1) between the horizontal plane HP and the center line CL of the clubshaft S under the reference state.

In this specification, the toe-heel direction of the head means a horizontal direction parallel with the reference vertical plane VP. The front-rear direction of the head means a direction orthogonal to the reference vertical plane VP. The up-and-down direction of the head means a direction orthogonal to the horizontal plane HP.

<Basic Configuration of Club Head>

The club head 2 has a shape being typical of iron clubs and comprising a clubface 3, a top 4, a sole 5, a toe 6 and a hosel 7, and is made of a metal material.

The clubface 3 is a substantially flat surface for hitting a ball, and provided with a plurality of face grooves 8 in order to increase the friction between the clubface 3 and ball. The face grooves 8 are parallel to each other and extend in the toe-heel direction of the head.

The top 4 is an upper surface part of the head 2 extending rearward from the upper edge of the clubface 3. The sole 5 is a bottom surface part of the head 2 extending rearward from the lower edge of the clubface 3.

The hosel 7 is for fixing the tip end of clubshaft S, and is formed in a cylindrical shape in this example.

The toe 6 is a part of the head 2 farthest from the hosel 7.

<Basic Configuration of Face Grooves>

Figure 3:
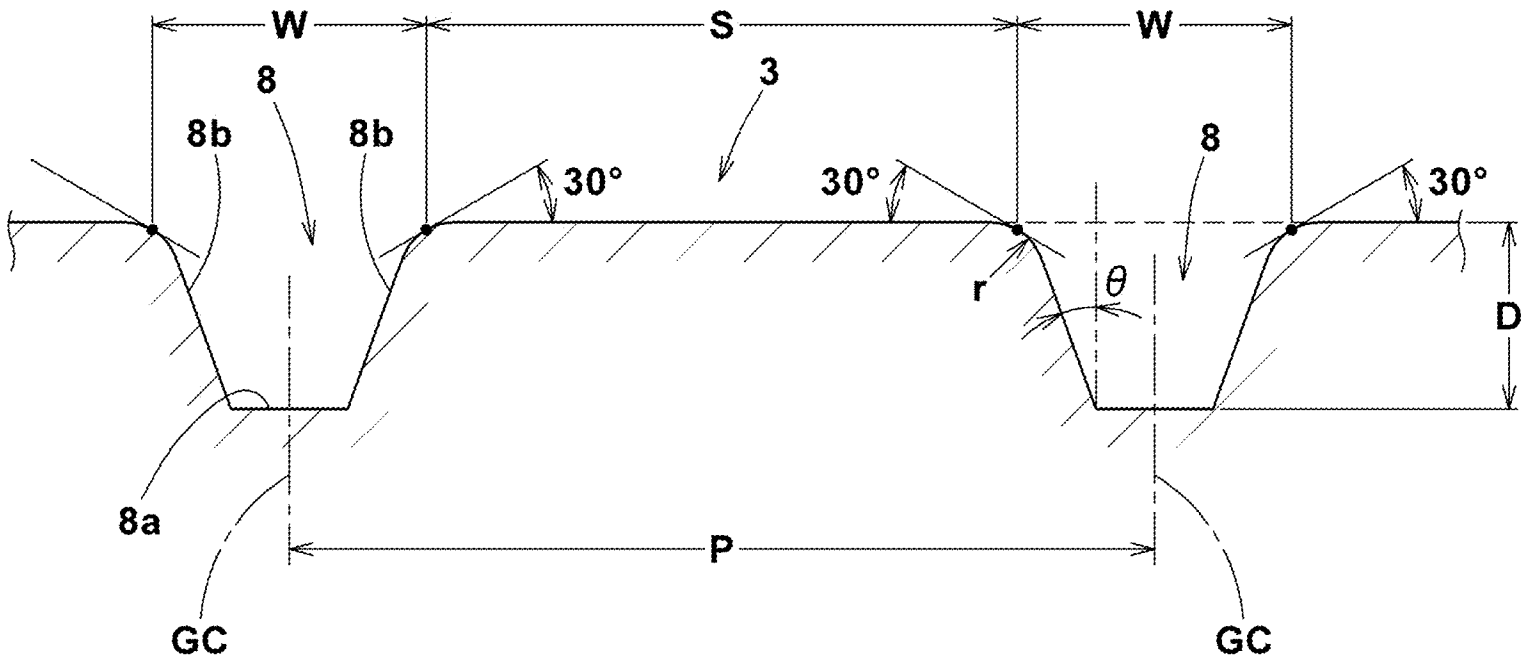
FIG. 3 is an enlarged cross-sectional view taken along line A-A in FIG. 1 for explaining the face grooves.

FIG. 3 shows a cross section of the face groove 8 perpendicular to the longitudinal direction thereof, taken along line A-A in FIG. 1.

As shown, the face groove 8 has a groove bottom 8*a* and a pair of groove walls 8*b*. For example, the groove bottom 8*a* is formed as a flat surface parallel with the clubface 3. The groove walls 8*b* of the face groove are each inclined to such a direction that the groove width increases from the groove bottom 8*a* toward the clubface 3. Each groove wall 8*b* is substantially a flat surface in the present embodiments. The groove walls 8*b* of each face groove are symmetrical about the widthwise center line GC of the face groove 8.

Incidentally, the terms "parallel" and the "symmetrical" should be understood in consideration of the machining accuracy when the face groove 8 are formed in the clubface 3 by machining, and these terms are intended to include "substantially parallel" and "substantially symmetrical".

The corners between the respective groove walls 8*b* and the clubface 3 are chamfered by a circular arc in the cross section. The radius r of this arc is defined to have an effective radius of at least 0.010 inch (0.254 mm) according to the Golf Rules for example.

In this specification, the Golf Rules mean the Rules of Golf provided by the R&A.

Each face groove 8 is specified by the depth D, the width W, the angle θ of the groove walls, and the groove arrangement pitch P.

Here, the depth D of the face groove 8 is the maximum distance in the direction perpendicular to the clubface 3 from the clubface 3 to the groove bottom 8*a*.

The width W of the face groove 8 is a measurement in accordance with the 30 degree measuring method for measuring the width of the face groove which is provided by the R&A.

The angle θ of the groove wall 8*b* is an acute angle formed between the normal line to the clubface 3 and the groove wall 8*b* in the cross section.

The pitch P is the distance between the center lines GC of the adjacent face grooves 8 in the cross section.

In the present embodiments, it is preferred that the depth D, the width W, the angle θ, the pitch P, the radius r of the circular arc of the chamfer, etc. are designed within respective ranges therefore in conformity with the Golf Rules.

<Golf Club Set of First Embodiment>

Figure 4:
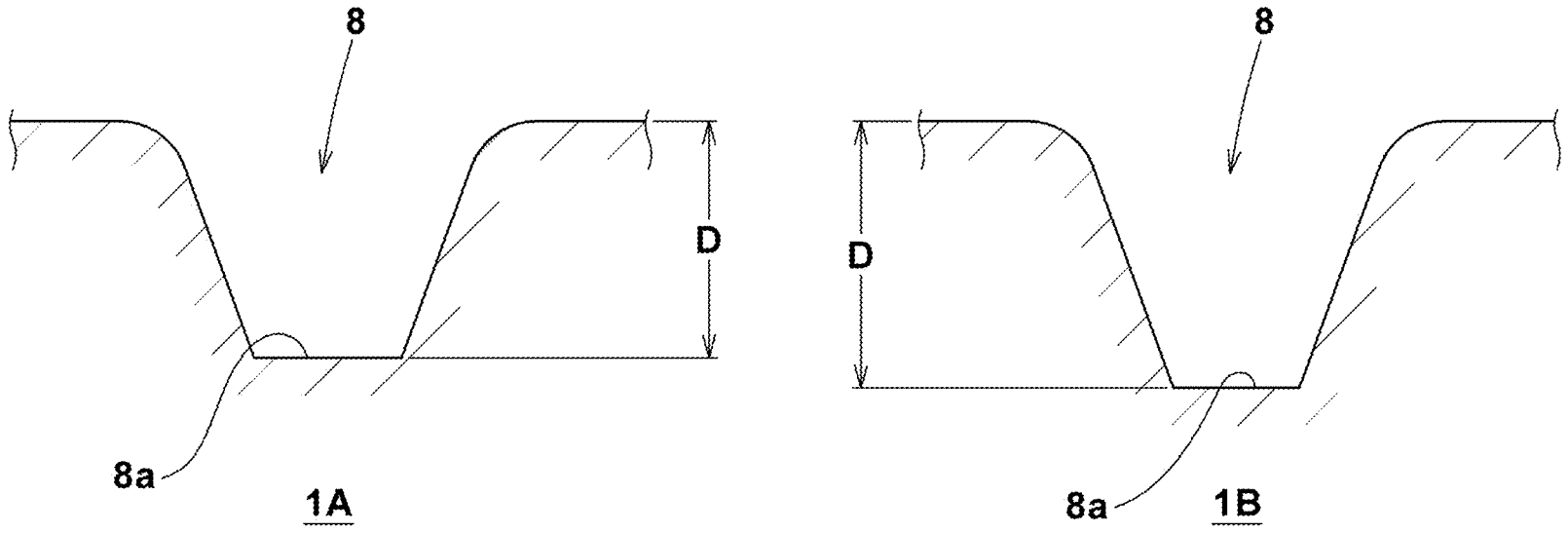
FIG. 4 shows two cross sectional views of face grooves of two respective golf clubs included in a golf club set of the first embodiment.

In an embodiment of the first invention (hereinafter, the first embodiment), the golf club set includes at least one 1st golf club 1A having a loft angle α of less than 34 degrees and provided with the face grooves 8 having a depth, and at least one 2nd golf club 1B having a loft angle α of not less than 34 degrees and provided with the face grooves 8 having a depth, wherein, as shown in FIG. 4, the depth D of the face grooves 8 of the above-said at least one 2nd golf club 1B is made larger than the depth D of the face grooves 8 of the above-said at least one 1st golf club 1A.

As discussed above in connection with FIG. 8, as a result of the analysis of the amount of backspin of balls hit by each golf club included in a golf club set under various hitting conditions, the present inventors found that the variation in the amount of backspin of the hit balls can be distinguished into two large trends by the loft angle of about 34 degrees as a turning point. That is, it was found that, in the 1st golf club 1A having a loft angle of less than 34 degrees, when the hitting condition changes toward low friction, the amount of backspin of the hit ball is first increased, and then the increased amount of backspin is maintained. On the other hand, in the 2nd golf club 1B having a loft angle of not less than 34 degrees, when the hitting condition changes toward low friction, the amount of backspin of the hit ball first increases, and then decreases largely.

Thus, paying attention to the difference between the trends of the change in the amount of backspin, the present inventors classified golf clubs included in a golf club set into two groups of 1st golf club 1A and 2nd golf club 1B, and then, for each golf club, a configuration optimized for stabilizing the amount of backspin was applied to the face grooves 8.

Tables 1 to 3 below show the results of ball hitting test conducted by using various 1st and 2nd golf clubs 1A and 1B, wherein 6-iron (α=28 degrees) was used as the 1st golf club 1A, and 8-iron (α=36 degrees) and pitching wedge (α=46 degrees) were used as the 2nd golf clubs 1B.

The clubfaces 3 of these golf clubs 1A and 1B were provided with face grooves 8 having different depths D and widths w as follows.

Face groove depths D: 0.2, 0.3, 0.4 and 0.5 mm

Face groove widths w: 0.6, 0.7, 0.8 and 0.9 mm

By combining the four different depths D and four different widths w, a total of 16 kinds of the face grooves 8 were provided.

In the ball hitting test, with respect to each golf club, there was measured the amount of backspin of the balls hit under various hitting conditions as explained above.

In general, in the case of a typical iron-type golf club set pursuant to the Golf Rules, angles of about 0 to 40 degrees are adopted in the groove walls of the face grooves.

On the occasion of the above-said hitting test, the present inventors examined the influence of the angle θ of the groove walls 8*b* by changing the angle θ within the above range, and it was found that the influence was very small. Thus, in each of the golf clubs used in the hitting test, the angle θ of the groove walls 8*b* of the face grooves 8*a* was set to a typical angle of 20 degrees based on this finding.

All of the golf clubs 1A and 1B were changed in the pitch P of the face grooves 8 according to the width W of the face grooves 8. More specifically, the pitch P of the face grooves 8 was set to a value (w×4+0.1 mm) obtained by adding 0.1 mm to four times the width W of the face grooves 8 as follows:

groove width W=0.9 mm: pitch P=3.7 mm groove width W=0.8 mm: pitch P=3.3 mm groove width W=0.7 mm: pitch P=2.9 mm groove width W=0.6 mm: Pitch P=2.5 mm The reason for setting the pitch P of the face grooves 8 in this way is based on the Golf Rules.

According to the Golf Rules, as shown in FIG. 3, the interval s of the adjacent face grooves 8 is required to be not less than three times the width W (maximum width) of the adjacent face grooves 8. Therefore, according to this rule, the pitch P of the adjacent grooves 8 can be set to a value not less than W×3+W×0.5+W×0.5, namely, four times the width W. In consideration of processing precision, the pitch P was set to a value w×4+0.1 mm so as not to deviate from the Golf Rules.

TABLE 1

| 6-Iron (#6: α = 27 deg.) | | | | | |
|---|---|---|---|---|---|
| | | Groove depth D (mm) | | | |
| | | 0.2 | 0.3 | 0.4 | 0.5 |
| DRY | | | | | |
| Groove width W (mm) | 0.9 | 5012 | 4962 | 4911 | 4793 |
| | 0.8 | 4955 | 4925 | 4895 | 4781 |
| | 0.7 | 4897 | 4882 | 4866 | 4768 |
| | 0.6 | | | 4912 | |
| WET | | | | | |
| Groove width W (mm) | 0.9 | 5571 | 5546 | 5521 | 5053 |
| | 0.8 | 5369 | 5319 | 5270 | 5186 |
| | 0.7 | 5166 | 5269 | 5372 | 5319 |
| | 0.6 | | | 5435 | |
| Turfgrass 2 | | | | | |
| Groove width W (mm) | 0.9 | 5862 | 5794 | 5727 | 5726 |
| | 0.8 | 5800 | 5700 | 5599 | 5630 |
| | 0.7 | 5738 | 5682 | 5626 | 5534 |
| | 0.6 | | | 5439 | |
| Turfgrass 3 | | | | | |
| Groove width W (mm) | 0.9 | 6137 | 6113 | 6090 | 6103 |
| | 0.8 | 6211 | 6109 | 6007 | 6033 |
| | 0.7 | 6285 | 6128 | 5972 | 5963 |
| | 0.6 | | | 5932 | |
| Turfgrass 4 | | | | | |
| Groove width W (mm) | 0.9 | 6294 | 6246 | 6197 | 6181 |
| | 0.8 | 6241 | 6143 | 6045 | 6165 |

TABLE 1-continued

| 6-Iron (#6: α = 27 deg.) | | | | | |
|---|---|---|---|---|---|
| | | Groove depth D (mm) | | | |
| | | 0.2 | 0.3 | 0.4 | 0.5 |
| | 0.7 | 6188 | 6181 | 6174 | 6149 |
| | 0.6 | | | 6146 | |
| Wet slit paper | | | | | |
| Groove width W (mm) | 0.9 | 4765 | 5316 | 5867 | 6208 |
| | 0.8 | 4963 | 5505 | 6048 | 6226 |
| | 0.7 | 5161 | 5727 | 6292 | 6243 |
| | 0.6 | | | 6347 | |

Note:

The units of the amount of backspin is rpm.

TABLE 2

| 8-Iron (#8: α = 36 deg.) | | | | | |
|---|---|---|---|---|---|
| | | Groove depth D (mm) | | | |
| | | 0.2 | 0.3 | 0.4 | 0.5 |
| DRY | | | | | |
| groove width W (mm) | 0.9 | 6347 | 6295 | 6243 | 6333 |
| | 0.8 | 6275 | 6371 | 6467 | 6302 |
| | 0.7 | 6204 | 6151 | 6099 | 6270 |
| | 0.6 | | | 6189 | |
| WET | | | | | |
| Groove width W (mm) | 0.9 | 7655 | 7580 | 7505 | 7568 |
| | 0.8 | 7642 | 7500 | 7359 | 7345 |
| | 0.7 | 7629 | 7401 | 7174 | 7122 |
| | 0.6 | | | 6934 | |
| Turfgrass 2 | | | | | |
| Groove width W (mm) | 0.9 | 7714 | 7571 | 7427 | 7345 |
| | 0.8 | 7717 | 7508 | 7299 | 7297 |
| | 0.7 | 7721 | 7506 | 7291 | 7250 |
| | 0.6 | | | 7283 | |
| Turfgrass 3 | | | | | |
| Groove width W (mm) | 0.9 | 7771 | 7711 | 7650 | 7638 |
| | 0.8 | 7766 | 7721 | 7676 | 7624 |
| | 0.7 | 7762 | 7709 | 7656 | 7610 |
| | 0.6 | | | 7637 | |
| Turfgrass 4 | | | | | |
| Groove width W (mm) | 0.9 | 7241 | 7425 | 7609 | 7621 |
| | 0.8 | 7231 | 7474 | 7717 | 7666 |
| | 0.7 | 7222 | 7438 | 7655 | 7711 |
| | 0.6 | | | 7593 | |
| Wet slit paper | | | | | |
| Groove width W (mm) | 0.9 | 4215 | 5332 | 6450 | 6861 |
| | 0.8 | 4351 | 5588 | 6824 | 7240 |
| | 0.7 | 4488 | 5816 | 7144 | 7618 |
| | 0.6 | | | 7246 | |

Note:

The units of the amount of backspin is rpm.

TABLE 3

| Pitching wedge (PW: α = 46 deg.) | | | | | |
|---|---|---|---|---|---|
| | | Groove depth D (mm) | | | |
| | | 0.2 | 0.3 | 0.4 | 0.5 |
| DRY | | | | | |
| Groove width W (mm) | 0.9 | 8049 | 7906 | 7762 | 7447 |
| | 0.8 | 7781 | 7743 | 7705 | 7669 |
| | 0.7 | 7513 | 7539 | 7565 | 7575 |
| | 0.6 | | | 7590 | |
| WET | | | | | |
| Groove width W (mm) | 0.9 | 8716 | 8879 | 9042 | 9126 |
| | 0.8 | 8969 | 9049 | 9130 | 9155 |
| | 0.7 | 9221 | 9143 | 9104 | 9065 |
| | 0.6 | | | 9168 | |
| Turfgrass 2 | | | | | |
| Groove width W (mm) | 0.9 | 9297 | 9143 | 8988 | 9153 |
| | 0.8 | 9115 | 9121 | 9127 | 9268 |
| | 0.7 | 8932 | 9091 | 9170 | 9249 |
| | 0.6 | | | 9230 | |
| Turfgrass 3 | | | | | |
| Groove width W (mm) | 0.9 | 7670 | 7977 | 8284 | 9053 |
| | 0.8 | 7704 | 8281 | 8858 | 8826 |
| | 0.7 | 7738 | 8333 | 8928 | 9072 |
| | 0.6 | | | 8977 | |
| Turfgrass 4 | | | | | |
| Groove width W (mm) | 0.9 | 5007 | 5964 | 6921 | 7806 |
| | 0.8 | 5592 | 6358 | 7123 | 7571 |
| | 0.7 | 6177 | 7089 | 8001 | 8324 |
| | 0.6 | | | 8415 | |
| Wet slit paper | | | | | |
| Groove width W (mm) | 0.9 | 4193 | 5096 | 5998 | 6711 |
| | 0.8 | 4483 | 5712 | 6941 | 6500 |
| | 0.7 | 4772 | 5889 | 7005 | 7093 |
| | 0.6 | | | 7120 | |

Note:
The units of the amount of backspin is rpm.

As shown in Tables 2 and 3, in the case of the 2nd golf club 1B, when the hitting condition is changed toward low friction, the amount of backspin of the hit ball tends to increase as the depth D of the face grooves 8 becomes larger.

When the width W of 0.8 mm and the depth D of 0.4 mm, which are typical of the face grooves 8, are taken as a reference, and difference therefrom is evaluated, the influence on the backspin amount per 0.1 mm of the depth D is as follows:

<8-Iron> in the case of "Turfgrass 3", almost zero in the case of "Turfgrass 4", about 150 rpm in the case of "Wet slit paper", about 900 rpm <Pitching Wedge> in the case of "Turfgrass 3", about 400 rpm in the case of "Turfgrass 4", about 800 rpm in the case of "Wet slit paper", 800 rpm From the above analysis results, it can be seen that, in the case of the 2nd golf club 1B, by increasing the depth D of the face grooves 8, even in the low-frictional hitting condition, the reduction in the amount of backspin of the hit ball can be suppressed, therefore, the flight distances of the hit balls can be stabilized under various frictional conditions.

By changing the angles θ of the groove walls 8*b* of the face grooves 8, similar tests as described above were made. As a result, it was found that the influence on the effect of stabilizing the amount of backspin was small.

On the other hand, in the case of the 1st golf club 1A having a small loft angle, unexpectedly, the amount of backspin is hardly decreased even if the hitting condition changes toward low friction. In the 1st golf club 1A, therefore, when the face grooves 8 having a large depth D are adopted, there is a tendency that, in the low frictional hitting condition, the amount of backspin is further increased, and the hit ball rises high. Thus, the intended flight distance can not be obtained. Therefore, in the present embodiment, the depth D of the face grooves 8 of the 1st golf club 1A is set to be smaller than that of the 2nd golf club 1B.

When taking the above characteristics into consideration, it is important for the 1st golf club 1A to reduce the difference in the amount of backspin between the DRY and wet slit paper conditions. Thus, by reducing the depth D of the face grooves 8 to reduce the difference in the amount of backspin, it becomes possible to stabilize the flight distance.

Preferably, the depth D of the face grooves 8 of the 1st golf club 1A is set to be less than 0.38 mm, more preferably not more than 0.35 mm, for example. As a result, the difference in the amount of backspin of the hit ball between the above-said two conditions can be reduced, and the flight distances of the hit balls can be stabilized.

It is preferable that the depth D of the face grooves 8 of the 1st golf club 1A is set to be not less than 0.15 mm, for example, in order to obtain a necessary minimum amount of backspin.

Preferably, the depth D of the face grooves 8 of the 2nd golf club 1B is set to be not less than 0.38 mm, more preferably not less than 0.40 mm, for example. As a result, even if the hitting conditions are changed, it is possible to suppress the change in the amount of backspin of the hit ball and further stabilize the flight distance of the hit ball.

Although the upper limit value of the depth D of the face grooves 8 is restricted according to the Golf Rules, it is preferable that the depth D of the 2nd golf club 1B is set to be not more than 0.50 mm, for example.

In the golf club set of the first embodiment, the pitch P of the face grooves 8 of each golf club 1 is not particularly limited, and can be appropriately determined according to the accepted practice.

However, in order to accord with the Golf Rules, it is preferable that the pitch P of the face grooves 8 is set to be not less than 4 times the width W of the face grooves 8 (hereinafter, may be referred to as "4 w").

Although the upper limit value for the pitch P is not particularly limited, it is preferable that the pitch P is 4 w+(0.4 mm or less), more preferably 4 w+(0.3 mm or less).

In the golf club set of the first embodiment, the width w of the face grooves 8 of each golf club 1 is not particularly limited, and can be appropriately determined according to the accepted practice.

However, it is preferable that the width W of the face grooves 8 is set in a range from 0.5 to 0.9 mm, more preferably a range from 0.6 to 0.9 mm.

In each of the golf clubs, the width W of the face grooves 8 may be constant.

In the golf clubs included in the golf club set, the width W of the face grooves 8 may be constant or may be changed.

The golf club set may include a plurality of 1st golf clubs 1A and a plurality of 2nd golf clubs 1B. In this case, the depths D of the face grooves 8 of all of the 2nd golf clubs 1B are larger than the depths D of the face grooves 8 of all of the 1st golf clubs 1A.

Table 4 shows examples 1 and 2 of the golf club set of the first embodiment satisfying the above-mentioned preferable aspects.

TABLE 4

| | | 1st golf club | | | | | 2nd golf club | | | | |
|---|---|---|---|---|---|---|---|---|---|---|---|
| | club number | #3 | #4 | #5 | #6 | #7 | #8 | #9 | PW | AW | SW |
| Example 1 | loft angle α (deg.) | 20 | 22 | 25 | 28 | 32 | 36 | 41 | 46 | 51 | 57 |
| | groove depth D (mm) | | | 0.35 | | | | | 0.43 | | |
| | groove pitch P (mm) | | | | | | 3.25 | | | | |
| | groove width W (mm) | | | | | | 0.70 | | | | |
| Example 2 | loft angle α (deg.) | 20 | 22 | 24 | 27 | 31 | 35 | 39 | 44 | 50 | 56 |
| | groove depth D (mm) | | | 0.35 | | | | | 0.38 | | |
| | groove pitch P (mm) | | | | | | 3.25 | | | | |
| | groove width W (mm) | | | | | | 0.70 | | | | |

<Golf Club Set of Second Embodiment>

Figure 5:
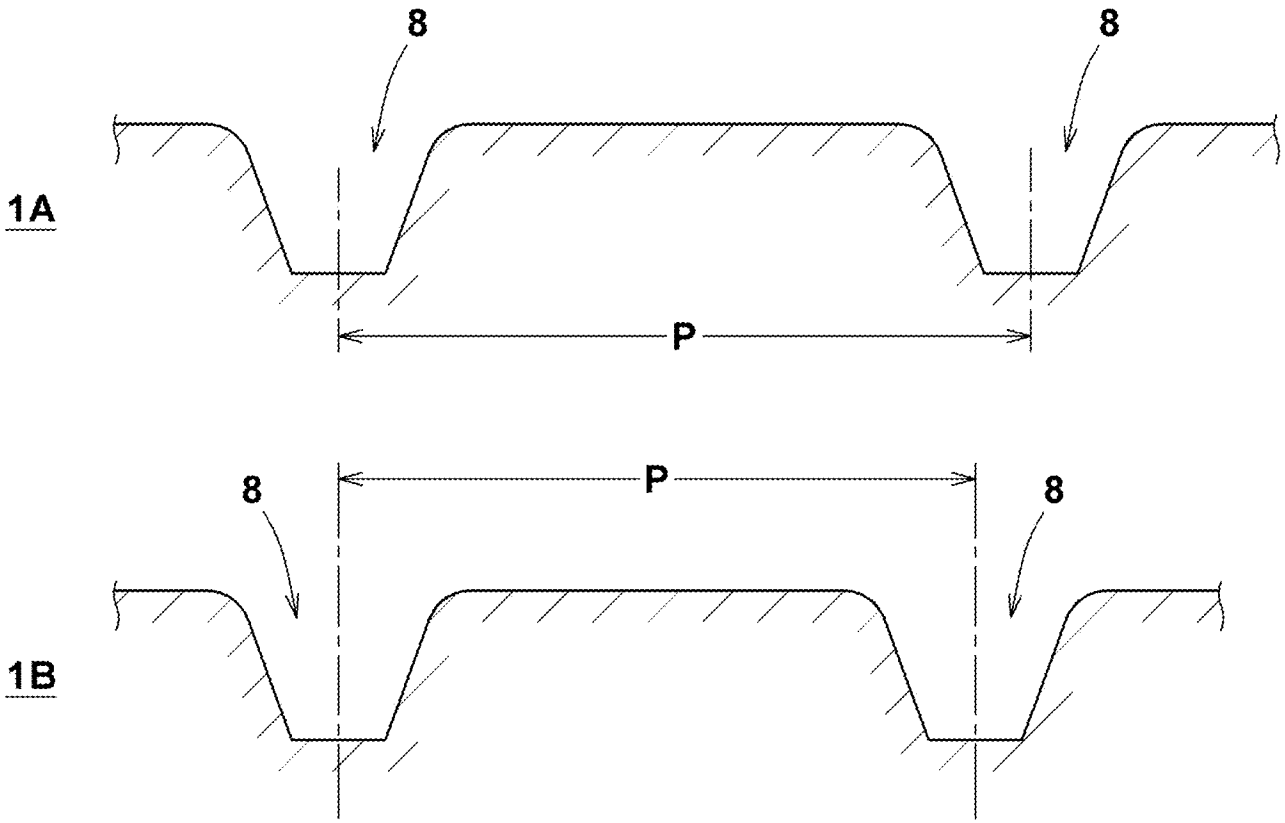
FIG. 5 shows two cross sectional views of face grooves of two respective golf clubs included in a golf club set of the second embodiment.

In an embodiment of the second invention (hereinafter, the second embodiment), the golf club set includes at least one 1st golf club 1A having a loft angle α of less than 34 degrees, and at least one 2nd golf club 1B having a loft angle α of not less than 34 degrees, wherein the pitch P of the face grooves 8 of the above-said at least one 2nd golf club 1B is smaller than the pitch P of the face grooves 8 of the above-said at least one 1st golf club 1A as shown in FIG. 5.

As described above, in the 1st golf club 1A having a loft angle of less than 34 degrees, as the hitting condition changes toward low friction, the amount of backspin of the hit ball increases, and then the increased amount of backspin is maintained.

In the 2nd golf club 1B having a loft angle of not less than 34 degrees, there is a tendency such that, as the hitting condition changes toward low friction, the amount of backspin of the hit ball once increases, then decreases remarkably.

In the second embodiment, therefore, based on the above findings, the pitch P of the face grooves 8 of the 2nd golf club 1B is made smaller than the pitch P of the face grooves 8 of the 1st golf club 1A. Thereby, in the low-frictional hitting condition of the 2nd golf club 1B, the hit ball comes into contact with more of the face grooves, and the remarkable decrease in the amount of backspin can be suppressed.

In the low-frictional hitting condition of the 1st golf club 1A, the hit ball comes into contact with lesser face grooves 8, and the increase in the amount of backspin can be suppressed. Therefore, in the golf club set of the second embodiment, the variation in the amount of backspin of the balls hit under the various hitting conditions possible in a golf course can be suppressed, and the flight distances of the hit balls can be stabilize.

Preferably, the pitch P of the face grooves 8 of the 1st golf club 1A is set to be not less than 3.35 mm, and the pitch P of the face grooves 8 of the 2nd golf club 1B is set to be less than 3.35 mm.

In the golf club set of the second embodiment, the depth D of the face grooves 8 is not particularly limited, and can be appropriately determined according to the accepted practice. However, it is preferable that the depth D of the face grooves 8 is selected from a range of from 0.15 to 0.50 mm, more preferably from a range of from 0.20 to 0.50 mm.

In each of the golf clubs, the depth D of the face grooves 8 may be constant.

In the golf clubs included in the golf club set, the depth D of the face grooves 8 may be constant or may be changed. In this case, it is preferable that the depth D is changed as described above in connection with the first embodiment.

In the golf club set of the second embodiment, the width w of the face grooves 8 of each golf club 1 is not particularly limited and can be appropriately determined according to the Golf Rules and the accepted practice.

However, it is preferable that the width W of the face grooves 8 is selected from a range of from 0.5 to 0.9 mm, more preferably from a range of from 0.6 to 0.9 mm.

In each of the golf clubs, the width W of the face grooves 8 may be constant.

In the golf clubs included in the golf club set, the width W of the face grooves 8 may be constant or may be changed. In this case, it is preferable to change as described later in connection with the undermentioned third embodiment.

The golf club set may include a plurality of the 1st golf clubs 1A and a plurality of the 2nd golf clubs 1B. In this case, the pitches P of the face grooves 8 of all of the 2nd golf clubs 1B are smaller than the pitches P of the face grooves 8 of all of the 1st golf clubs 1A.

Table 5 shows an example 3 of the golf club set of the second embodiment satisfying the above-mentioned preferred aspects.

TABLE 5

| | | 1st golf club | | | | | 2nd golf club | | | | |
|---|---|---|---|---|---|---|---|---|---|---|---|
| | club number | #3 | #4 | #5 | #6 | #7 | #8 | #9 | PW | AW | SW |
| Example 3 | loft angle α (deg.) | 20 | 22 | 25 | 28 | 32 | 36 | 41 | 46 | 51 | 57 |
| | groove depth D (mm) | | | | | | 0.35 | | | | |
| | groove pitch P (mm) | | | 3.45 | | | | | 3.25 | | |
| | groove width W (mm) | | | | | | 0.70 | | | | |

<Golf Club Sets of Third-Fifth Embodiments>

Figure 6:
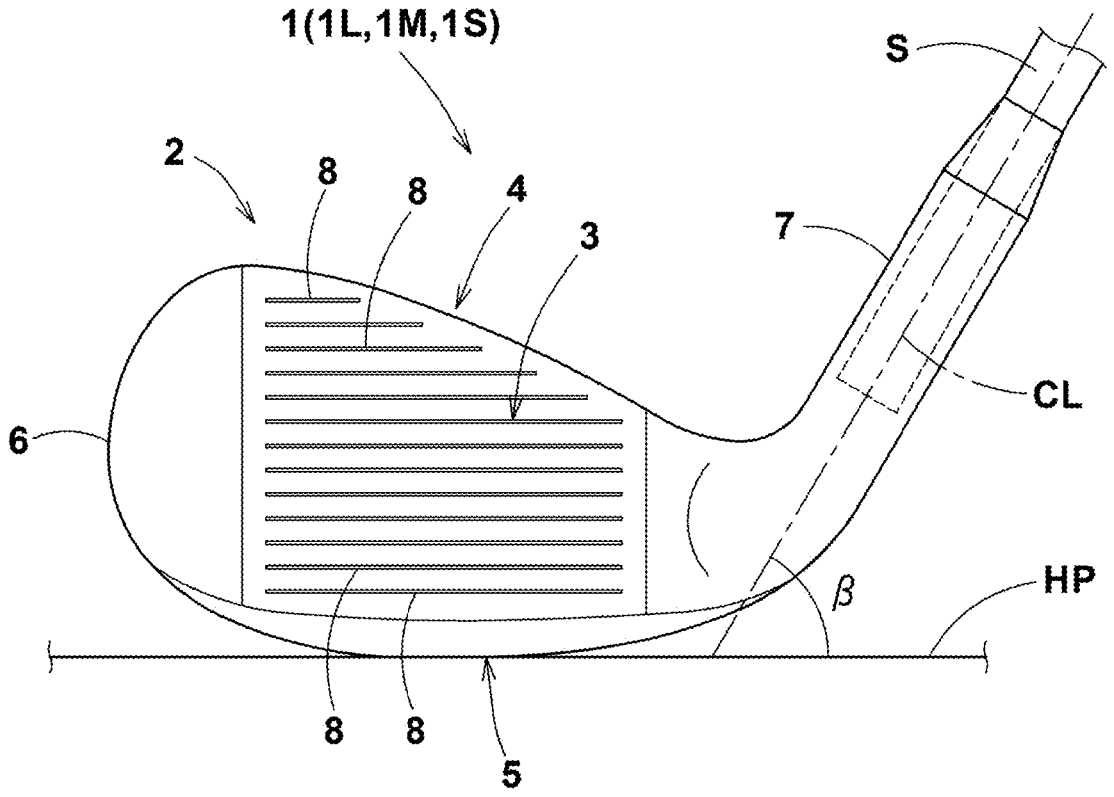
FIG. 6 is a partial front view of a golf club exemplifying three golf clubs included in golf club sets as third to fifth embodiment of the third to fifth inventions, respectively.
Figure 7:
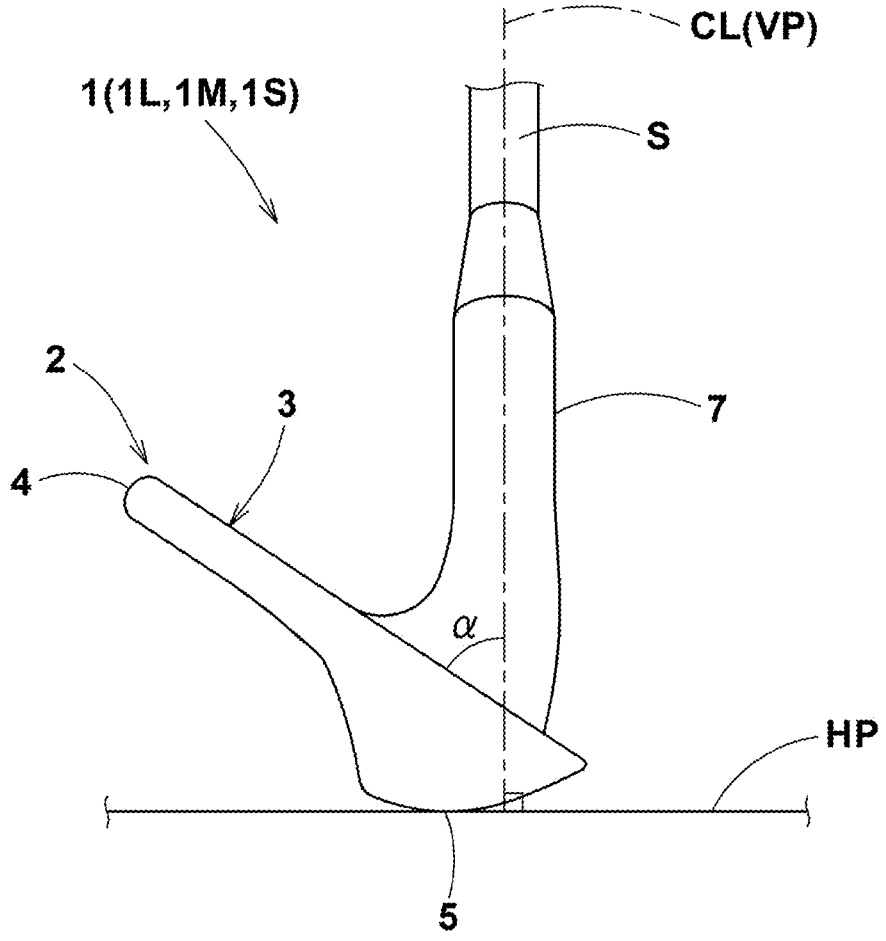
FIG. 7 is a side view of the golf club shown in FIG. 6.

FIGS. 6 and 7 are the front view and the side view from the toe side, respectively, of a part (golf club head 2) of an exemplary golf club 1 included in the golf club sets as embodiments of the third-fifth inventions (hereinafter, the third-fifth embodiments, respectively).

Each golf club set includes a plurality of golf clubs 1 having different loft angles α, which are typically configured as iron-type golf clubs. Such iron-type golf clubs may include a plurality of golf clubs selected from, for example, 3 to 9-irons, pitching wedges, approach wedges and sand wedges.

In the third-fifth embodiments, the above-said plurality of golf clubs 1 include at least one low-number golf club 1L having a loft angle α of less than 26 degrees, at least one middle-number golf club 1M having a loft angle α of not less than 26 degrees and less than 39 degrees, and at least one high-number golf club 1S having a loft angle α of not less than 39 degrees.

Each of the above-said at least one low-number golf club 1L, the above-said at least one middle-number golf club 1M and the above-said at least one high-number golf club 1S comprises a clubface 3 provided with a plurality of face grooves 8.

The face grooves 8 have the cross-sectional shape and the arrangement pitch as shown in FIG. 3.

<Golf Club Set of Third Embodiment>

In the golf club set of the third embodiment of the third invention, the depth D of the face grooves 8 of the above-said at least one high-number golf club 1S is made greater than the depth D of the face grooves 8 of the above-said at least one middle-number golf club 1M, and the depth D of the face grooves 8 of the above-said at least one middle-number golf club 1M is made greater than the depth D of the face grooves 8 of the above-said at least one low-number golf club 1L.

Figure 8:
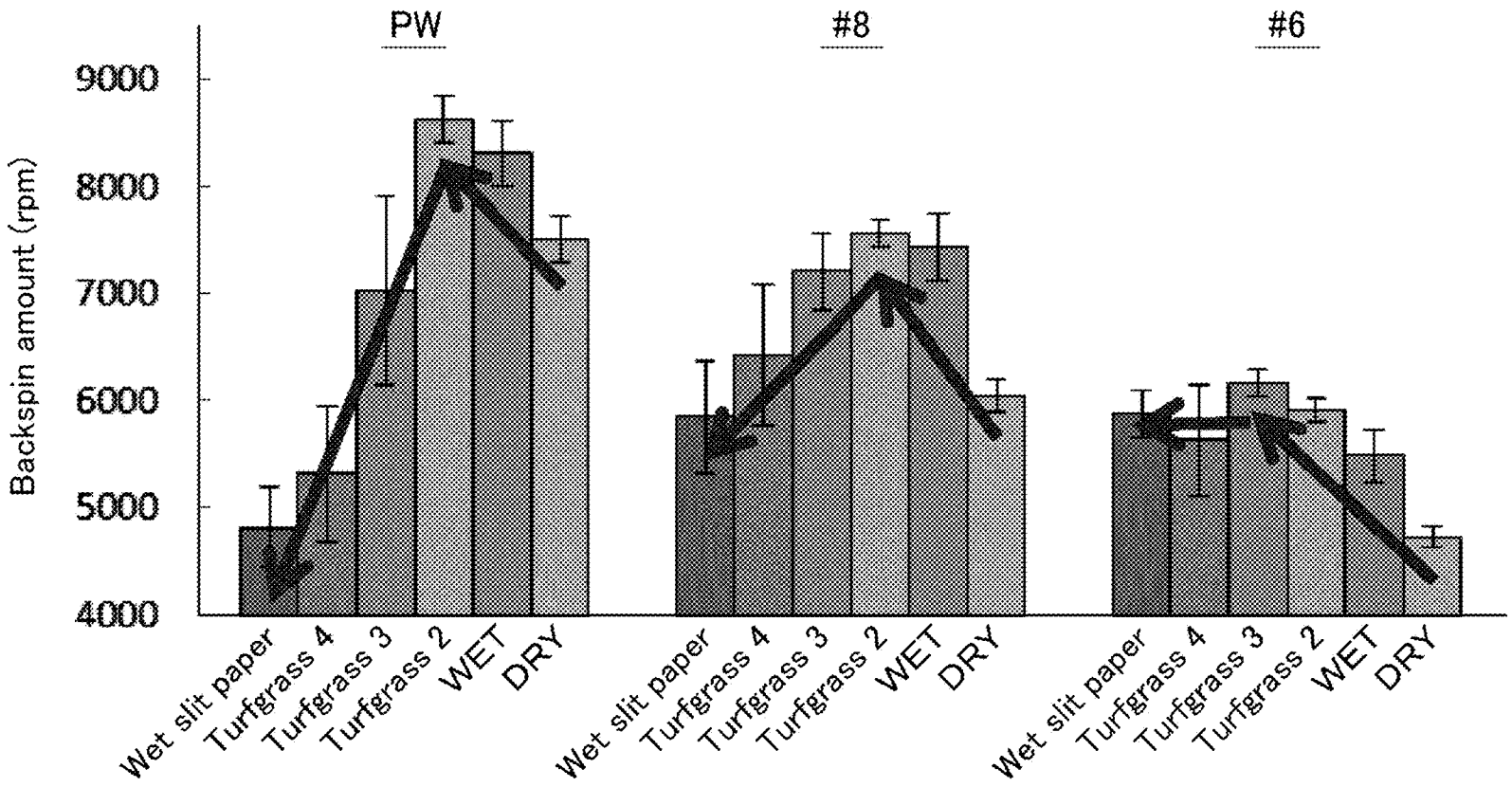
FIG. 8 is a graph showing the amount of backspin of balls hit by three kinds of golf clubs having different loft angles under various hitting conditions.

The present inventors made a further detailed analysis of the amount of backspin of the ball hit by the golf clubs having different loft angles under the various conditions "DRY"-"Wet slit paper" as shown in FIG. 8. As a result, it was found that the changing trend of the amount of backspin can be distinguished into three trends in more detail as follows:

(1) in the low-number golf club 1L having a loft angle α of less than 26 degrees, when the reducing of the friction at the time of hitting a ball is progressed, the amount of backspin of the hit balls is increased, and then the increased amount of backspin is maintained;

(2) in the high-number golf club 1S having a loft angle α of not less than 39 degrees, when the reducing of the friction at the time of hitting a ball is progressed, the amount of backspin of the hit balls is once increased, then decreases remarkably; and (3) in the middle-number golf club 1M having a loft angle of not less than 26 degrees and less than 39 degrees, as the loft angle α is increased, the changing trend gradually changes from the above trend of the low-number golf club 1L to the above trend of the high-number golf club 1S.

In the third embodiment, therefore, based on the above findings, the depth D of the face grooves 8 of the high-number golf club 1S is made larger than the depth D of the face grooves 8 of the middle-number golf club 1M, and the depth D of the face grooves 8 of the middle-number golf club 1M is made larger than the depth D of the face grooves 8 of the low-number golf club 1L.

As a result, in the low-frictional hitting condition of the high-number golf club 1S, the hit ball deeply engages with the face grooves 8, and the remarkable decrease in the amount of backspin is suppressed.

In the low-frictional hitting condition of the low-number golf club 1L, the hit ball engages shallowly with the face grooves 8, and the increase in the amount of backspin is suppressed.

Further, as the face grooves 8 of the middle-number golf club 1M is provided with intermediate characteristics of face grooves between the low-number golf club 1L and the high-number golf club 1S, the amount of backspin is stabilized.

Thus, in the golf club set of the third embodiment, since the golf clubs 1*s*, 1M and 1L are finely differentiated from each other with respect to the depth D of the face grooves 8 according to the loft angle α, it is possible to further suppress the variation in the amount of backspin of the balls hit under the various hitting conditions possible in a golf course, and the flight distances of the hit balls can be further stabilized.

Preferably, the depth D of the face grooves 8 of the low-number golf club 1L is set in a range of not more than 0.30 mm. As a result, in the low-number golf club 1L, even if the hitting condition is changed, the variation in the amount of backspin of the hit balls can be effectively suppressed, and the flight distances of the hit balls can be further stabilized. In order to obtain the necessary minimum amount of backspin, the lower limit for the depth D of the face grooves 8 of the low-number golf club 1L is preferably set to be not less than 0.15 mm, for example.

Preferably, the depth of the face grooves 8 of the high-number golf club 1S is set to be not less than 0.40 mm.

As a result, in the high-number golf club 1S, even if the hitting condition is changed, the variation in the amount of backspin of the hit balls can be suppressed to a smaller extent, and the flight distances of the hit balls can be further stabilized.

The upper limit for the depth D of the face grooves 8 of the high-number golf club 1S is restricted according to the Golf rules. For example, the upper limit is set to be not more than 0.50 mm.

Preferably, the depth D of the face grooves 8 of the middle-number golf club 1M is set to a value between the depth D of the face grooves 8 of the low-number golf club 1L and the depth D of the face grooves 8 of the high-number golf club 1S, for example, a value of greater than 0.30 mm and smaller than 0.40 mm.

In the golf club set of the third embodiment, the pitch P of the face grooves 8 of each golf club 1 is not particularly limited, and can be appropriately determined according to the accepted practice.

However, it is preferable that the pitch P of the face grooves 8 is set to be not less than 4 w (mm) so as to comply with the Golf rules.

Although, the upper limit for the pitch P is not particularly limited, the pitch P is preferably 4 w+(0.4 mm or less), more preferably 4 w+(0.3 mm or less).

In each of the golf clubs, the pitch P of the face grooves 8 may be constant.

In the golf clubs included in the golf club set, the pitch P of the face grooves 8 may be constant or may be changed. In this case, it is preferable that the pitch P is changed as described later in connection with the undermentioned fourth embodiment.

In the golf club set of the third embodiment, the width w of the face grooves 8 of each golf club 1 is not particularly limited, and can be appropriately determined according to the accepted practice.

However, it is preferable that the width W of the face grooves 8 is set in a range from 0.5 to 0.9 mm, more preferably in a range from 0.6 to 0.9 mm.

In the golf clubs included in the golf club set, the width W of the face grooves 8 may be constant or may be changed.

The golf club set of the third embodiment may include a plurality of the low-number golf clubs 1L, a plurality of the middle-number golf clubs 1M and a plurality of the high-number golf clubs 1S.

It is preferable that the golf club set of the third embodiment includes a plurality of golf clubs selected from, for example, 3 to 9-irons, pitching wedges, approach wedges and sand wedges when according with a customary combination of loft angles and club numbers.

The golf club set of the third embodiment may include a plurality of the low-number golf clubs 1L, a plurality of the middle-number golf clubs 1M and a plurality of the high-number golf clubs 1*s*, wherein the depths D of the face grooves 8 of all of the high-number golf clubs 1*s* are larger than the depths D of the face grooves 8 of all of the middle-number golf clubs 1M, and the depths D of the face grooves 8 of all of the middle-number golf clubs 1M are larger than the depths D of the face grooves 8 of all of the low-number golf clubs 1L.

Table 6 shows an example 4 of the golf club set of the third embodiment which satisfies the above-described preferable aspects.

TABLE 6

| | | Low-number golf club | | | Middle-number golf club | | | High-number golf club | | | |
|---|---|---|---|---|---|---|---|---|---|---|---|
| | club number | #3 | #4 | #5 | #6 | #7 | #8 | #9 | PW | AW | SW |
| Example 4 | loft angle α (deg.) | 20 | 22 | 25 | 28 | 32 | 36 | 41 | 46 | 51 | 57 |
| | groove depth D (mm) | | 0.30 | | | 0.38 | | | | 0.43 | |
| | groove pitch P (mm) | | | | | 3.25 | | | | | |
| | groove width W (mm) | | | | | 0.70 | | | | | |

<Golf Club Set of Fourth Embodiment>

In the golf club set of the fourth embodiment of the fourth invention, the pitch P of the face grooves 8 of the clubface 3 of the above-said at least one high-number golf club 1S is made smaller than the pitch P of the face grooves 8 of the clubface 3 of the above-said at least one middle-number golf club 1M, and the pitch P of the face grooves 8 of the clubface 3 of the above-said at least one middle-number golf club 1M is made smaller than the pitch P of the face grooves 8 of the clubface 3 of the above-said at least one low-number golf club 1L.

In the fourth embodiment, based on the findings (1), (2) and (3), the pitch P of the face grooves 8 is changed so as to become smaller as the golf club 1 has a larger loft angle α. As a result, in the low-frictional hitting condition of the high-number golf club 1S, the hit ball comes into contact with more of the face grooves 8, and the remarkable decrease in the amount of backspin can be suppressed.

In the low-frictional hitting condition of the low-number golf club 1L, the hit ball comes into contact with lesser face grooves 8, and the increase in the amount of backspin can be suppressed.

Further, since the face grooves 8 of the middle-number golf club 1M are provided with intermediate characteristics of face grooves between the low-number golf club 1L and the high-number golf club 1S, the amount of the back spin is stabilized under various hitting conditions.

Thus, in the golf club set of the fourth embodiment, since the pitches P of the face grooves 8 are finely differentiated from each other according to the loft angles α, the variation in the backspin of the balls hit under various hitting conditions possible in a golf courses, is suppressed, and as a result, the flight distances of the hit balls can be stabilized.

Preferably, the pitch P of the face grooves 8 of the low-number golf club 1L is set to be not less than 3.40 mm, more preferably not less than 3.45 mm. Thereby, in the low-number golf club 1L, the variation in the amount of backspin of the hit balls can be suppressed to a smaller extent even if the hitting condition is changed. and the flight distances of the hit balls is stabilized.

Preferably, the pitch P of the face grooves 8 of the high-number golf club 1S is set to be not more than 3.30 mm, more preferably not more than 3.25 mm. Thereby, in the high-number golf club 1S, the variation in the amount of backspin of the hit balls can be suppressed to a smaller extent even if the hitting condition is changed, and the flight distances of the hit balls can be stabilized.

Preferably, the pitch P of the face grooves 8 of the middle-number golf club 1M is set to be a value between the pitch P of the face grooves 8 of the low-number golf club 1L and the pitch P of the face grooves 8 of the high-number golf club 1S, namely, a value of greater than 3.30 mm and less than 3.40 mm.

In the golf club set of the fourth embodiment, the depth D of the face grooves 8 of each golf club 1 is not particularly limited, and can be appropriately determined according to the accepted practice.

However, it is preferable that the depth D of the face grooves 8 is selected from a range of from 0.15 to 0.50 mm, more preferably from a range of from 0.20 to 0.50 mm.

In each golf club, the depth D of the face grooves 8 may be constant.

In the golf clubs included in the golf club set, the depth D of the face grooves 8 may be constant or may be changed. In this case, it is preferable that the depth D is changed as described above in connection with the third embodiment.

In the golf club set of the fourth embodiment, the width w of the face grooves 8 of each golf club 1 is not particularly limited, and can be appropriately determined according to the accepted practice.

However, it is preferable that the width W of the face grooves 8 is selected from a range of from 0.5 to 0.9 mm, more preferably from a range of from 0.6 to 0.9 mm.

In each golf club, the width W of the face grooves 8 may be constant.

In the golf clubs included in the golf club set, the width W of the face grooves 8 may be constant or may be changed.

The golf club set of the fourth embodiment may include a plurality of the low-number golf clubs 1L, a plurality of the middle-number golf clubs 1M and a plurality of the high-number golf clubs 1*s*, wherein the pitches P of the face grooves 8 of all of the high-number golf clubs 1*s* are smaller than the pitches P of the face grooves 8 of all of the middle-number golf clubs 1M, and the pitches P of the face grooves 8 of all of the middle-number golf clubs 1M are smaller than the pitches P of the face grooves 8 of all of the low-number golf clubs 1L.

Preferably, the golf club set of the fourth embodiment includes a plurality of golf clubs selected from, for example, 3 to 9-irons, pitching wedges, approach wedges and sand wedges when according with a customary combination of loft angles and club numbers.

Table 7 shows an example 5 of the golf club set of the fourth embodiment satisfying the above-described preferable aspects.

TABLE 7

| | | Low-number golf club | | | Middle-number golf club | | | High-number golf club | | | |
|---|---|---|---|---|---|---|---|---|---|---|---|
| | club number | #3 | #4 | #5 | #6 | #7 | #8 | #9 | PW | AW | SW |
| Example 5 | loft angle α (deg.) | 20 | 22 | 25 | 28 | 32 | 36 | 41 | 46 | 51 | 57 |
| | groove depth D (mm) | | | | | 0.35 | | | | | |
| | groove pitch P (mm) | | 3.45 | | | 3.35 | | | | 3.25 | |
| | groove width W (mm) | | | | | 0.70 | | | | | |

<Golf Club Set of Fifth Embodiment>

The golf club set of the fifth embodiment of the fifth invention is an embodiment provided with a combination of the depths D and the pitches P of the face grooves 8 described in connection with the third embodiment and the fourth embodiment.

In the fifth embodiment, both of the depths D and the pitches P of the face grooves 8 are finely differentiated from each other according to the loft angles α, and thereby, the variation in the amount of backspin of the balls hit under the various hitting conditions possible in a golf course are suppressed to enable the flight distances of the hit balls to be stabilized.

Table 8 shows an example 6 of the golf club set of the fifth embodiment satisfying the above-described preferable aspects.

TABLE 8

| | | Low-number golf club | | | Middle-number golf club | | | High-number golf club | | | |
|---|---|---|---|---|---|---|---|---|---|---|---|
| | club number | #3 | #4 | #5 | #6 | #7 | #8 | #9 | PW | AW | SW |
| Example 6 | loft angle α (deg.) | 20 | 22 | 25 | 28 | 32 | 36 | 41 | 46 | 51 | 57 |
| | groove depth D (mm) | | 0.30 | | | 0.38 | | | | 0.43 | |
| | groove pitch P (mm) | | 3.45 | | | 3.35 | | | | 3.25 | |
| | groove width W (mm) | | 0.80 | | | 0.75 | | | | 0.70 | |

While detailed description has been made of preferable embodiments of the present inventions, the present inventions can be embodied in various forms without being limited to the illustrated embodiments.

In particular, the illustrated embodiments should not be strictly interpreted as being mutually independent. For example, an embodiment obtained by replacing some elements of an embodiment with some elements described in another embodiment should be understood as within the scope of the disclosure of present invention.

DESCRIPTION OF THE REFERENCE SIGNS

1 golf club

1A 1st golf club

1B 2nd golf club

1L low-number golf club

1M middle-number golf club

1S high-number golf club

2 club head

3 clubface

8 face groove

P face groove pitch

W face groove width

α loft angle

The invention claimed is:

1. A golf club set including a plurality of golf clubs having different loft angles, wherein the golf clubs include at least one low-number golf club having a loft angle of less than 26 degrees, at least one middle-number golf club having a loft angle of not less than 26 degrees and less than 39 degrees, and at least one high-number golf club having a loft angle of not less than 39 degree, wherein each of said at least one low-number golf club, said at least one middle-number golf club and said at least one high-number golf club comprises a clubface provided with a plurality of face grooves having a pitch, the pitch of the face grooves of said at least one high-number golf club is smaller than the pitch of the face grooves of said at least one middle-number golf club, and the pitch of the face grooves of said at least one middle-number golf club is smaller than the pitch of the face grooves of said at least one low-number golf club, wherein the pitch of the face grooves of said at least one high-number golf club is not more than 3.30 nm.

2. The golf club set according to claim 1, wherein the pitch of the face grooves of said at least one low-number golf club is not less than 3.40 mm.

* * * * *